US007215914B2

(12) United States Patent
Murakami et al.

(10) Patent No.: US 7,215,914 B2
(45) Date of Patent: May 8, 2007

(54) TRANSFER DEVICE

(75) Inventors: Susumu Murakami, Soraku-gun (JP); Takahiro Fukunaga, Sakurai (JP); Yoshie Iwakura, Higashiosaka (JP); Kuniaki Nakano, Soraku-gun (JP); Hideshi Izumi, Ikoma (JP); Minoru Tomiyori, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 125 days.

(21) Appl. No.: 10/963,692

(22) Filed: Oct. 14, 2004

(65) Prior Publication Data

US 2005/0084301 A1 Apr. 21, 2005

(30) Foreign Application Priority Data

Oct. 21, 2003 (JP) ..... 2003-360735

(51) Int. Cl.
*G03G 15/00* (2006.01)
*G03G 15/01* (2006.01)

(52) U.S. Cl. ..... 399/313; 399/299

(58) Field of Classification Search ..... 399/299, 399/302, 303, 308, 313
See application file for complete search history.

(56) References Cited

U.S. PATENT DOCUMENTS 4,873,541 A 10/1989 Hirose et al.
5,469,248 A * 11/1995 Fujiwara et al. ..... 399/313 X
6,445,899 B2 * 9/2002 Sato ..... 399/299 X
6,594,460 B1 * 7/2003 Williams et al. ..... 399/165
6,798,430 B2 * 9/2004 Sato ..... 399/299 X
6,850,726 B1 * 2/2005 Mizuno et al. ..... 399/299
6,862,422 B2 * 3/2005 Aoki et al. ..... 399/313

FOREIGN PATENT DOCUMENTS

JP 2574804 B2 10/1986
JP 10-39651 A 2/1998
JP 10-293437 A 11/1998
JP 2003-91133 A 3/2003

* cited by examiner

*Primary Examiner*—Sandra L. Brase
(74) *Attorney, Agent, or Firm*—Nixon & Vanderhye P.C.

(57) ABSTRACT

A transfer device is provided including an intermediate transfer belt and transfer rollers associated with respective of photosensitive drums. Each of the transfer rollers and the intermediate transfer belt define therebetween a contact range of which center lies downstream of the center of a contact range (transfer nip region) defined between the associated photosensitive drum and the endless belt in the direction of movement of the endless belt. The transfer roller deforms the path of movement of the intermediate transfer belt by contacting the intermediate transfer belt, and the resulting deformation causes the intermediate transfer belt to contact the periphery of the photosensitive drum over a predetermined range.

8 Claims, 5 Drawing Sheets

TRANSFER DEVICE

CROSS REFERENCE

This Nonprovisional application claims priority under 35 U.S.C. § 119(a) on Patent Application No. 2003-360735 filed in Japan on Oct. 21, 2003, the entire contents of which are hereby incorporated by reference.

BACKGROUND OF THE INVENTION

1. Field of the Invention

The present invention relates to a transfer device operative to transfer a toner image formed on an image carrier by electrophotographic image formation to a recording medium such as a recording sheet (hereinafter will be referred to as "recording sheet") via an endless belt. More particularly, the invention relates to a transfer device operative to transfer such a toner image from the image carrier to the endless belt or a recording sheet on the endless belt by the use of a transfer roller.

2. Description of the Related Art

Full-color image forming apparatus perform image formation using color toners corresponding to plural colors which are indicated by respective image data items obtained by color separation of a color image. For example, such image formation includes: reading the same color image through filters for three additive primary colors (red, green and blue); creating image data items respectively indicative of at least three subtractive primary colors (cyan, magenta and yellow) from the data thus read; forming visualized images based on the respective image data items using color toners respectively corresponding to the colors indicated by the respective image data items; and superimposing the visualized images of the respective colors one upon another to form a full-color image.

Heretofore, a tandem type full-color image forming apparatus has been proposed which includes a revolvable semi-conducting endless belt and a row of image forming sections arranged in the direction of movement of the outer peripheral surface of the endless belt, the image forming sections being configured to individually form visualized images colored-different from each other, and which forms one full-color image during at least one revolution of the endless belt.

Tandem type full-color image forming apparatus described in Japanese Patent Application Laid-Open Nos. H10-039651 and H10-293437 and Japanese Patent No. 2574804 are capable of higher-speed full-color image formation by employing either an intermediate transfer method including superimposing visualized images of respective colors formed at respective image forming sections one upon another on the outer peripheral surface of an endless belt, followed by transfer of the resulting image to a recording sheet or a transfer feed method including sequentially transferring visualized images of respective colors formed at the respective image forming sections to a surface of a recording medium being fed as attracted onto the outer peripheral surface of an endless belt.

Such a conventional tandem type full-color image forming apparatus is configured to form toner images on respective image carriers based on image information items obtained by color separation at the respective image forming sections and then transfer the toner images from the image carriers to the endless belt or a recording sheet being fed by the endless belt via transfer rollers. As shown in FIGS. 1A and 1B, transfer roller 201 abuts against image carrier 203 with endless belt 202 intervening therebetween. The rotating shaft 201A of the transfer roller 201 extends parallel with the rotating shaft 203A of the image carrier 203 while being positioned on normal LV passing through a point of contact PC between the periphery of the image carrier 203 and the direction of movement of the endless belt 201. The transfer roller 201 is in contact with the endless belt 202 at the point of contact PC on the normal LV.

The peripheral surface of the transfer roller 201 is formed of a material which is softer than the surface of the image carrier 203. The transfer roller 201 is biased toward the rotating shaft 203A of the image carrier 203 along the normal LV and hence is pressed against the image carrier 203 across the endless belt 202. By this arrangement the transfer roller 201 and the image carrier 203 define therebetween a transfer nip region N having a predetermined width in the direction of movement of the endless belt 202. A toner image is transferred from the image carrier 203 to the endless belt 202 or a recording sheet through this transfer nip region N.

Since such a conventional full-color image forming apparatus has the above-described arrangement wherein the transfer nip region having the predetermined width in the direction of movement of the endless belt is defined by pressing the transfer roller having a lower surface hardness than the image carrier against the image carrier, exact transfer of a toner image becomes difficult due to instability in the circumferential velocity ratio between the endless belt and the image carrier which occurs when the velocity of the endless belt passing through the transfer nip region varies. Variations in the velocity of the endless belt passing through the transfer nip region are likely to occur due to variations in the coefficient of friction between the endless belt and the image carrier with environmental changes or with time.

The intermediate transfer type full-color image forming apparatus needs to have an increased nip width defined between the transfer roller and the image carrier in order to ensure reliable transfer of a toner image from the image carrier to the endless belt. As the nip width increases, the endless belt and the image carrier press against each other with increasing force, causing toner to aggregate. Such an aggregate of toner is likely to remain on the endless belt without transfer to a recording sheet. As a result, the image on the recording sheet suffers from voids (the phenomenon that toner forming inside portions of an image such as a character fail to transfer) and, hence, the image quality thereof is degraded. Further, the increase in the pressing force between the endless belt and the image carrier is likely to cause toner present on the upstream side of the endless belt to return to an image carrier on the downstream side, thus raising the problem of disagreement in image color due to undesirable mixture of color toners.

A feature of the present invention is to provide a transfer device for use in image forming apparatus which defines a transfer nip region having a predetermined width in the direction of movement of an endless belt without pressing a transfer roller against an image carrier across the endless belt, thereby preventing variations in the velocity of the endless belt passing through the transfer nip region, degradation in image quality due to toner aggregation, undesired entry of toner into the developing device of another image forming section, and an increase in toner consumption.

SUMMARY OF THE INVENTION

The present invention provides an arrangement including: an endless belt operative to move with its outer surface contacting the periphery of one image carrier or the peripheries of plural image carriers; and a transfer roller associated with each of the image carriers and configured to contact the inner surface of the endless belt, wherein the transfer roller and the endless belt define therebetween a contact range of which center lies at a location different from a center of a contact range defined between the image carrier associated with the transfer roller and the endless belt in the direction of movement of the endless belt.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

The present invention will now be described in detail with reference to the drawings.

Figure 1A:
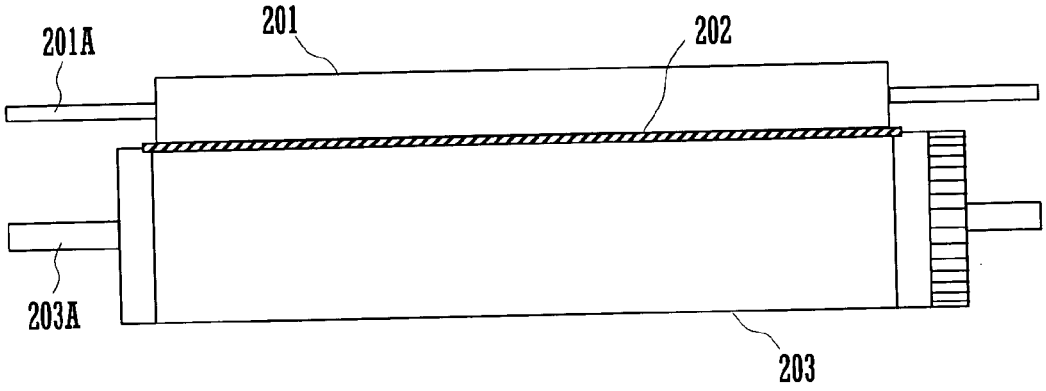
FIGS. 1A and 1B are views illustrating an arrangement in which an intermediate transfer belt, photosensitive drum and transfer roller of a conventional image forming apparatus are positioned.
Figure 1B:
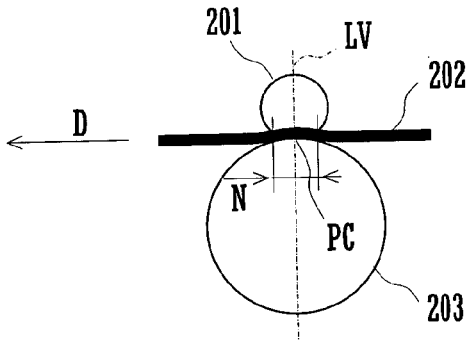
FIG.1B PRIOR ART
Figure 2:
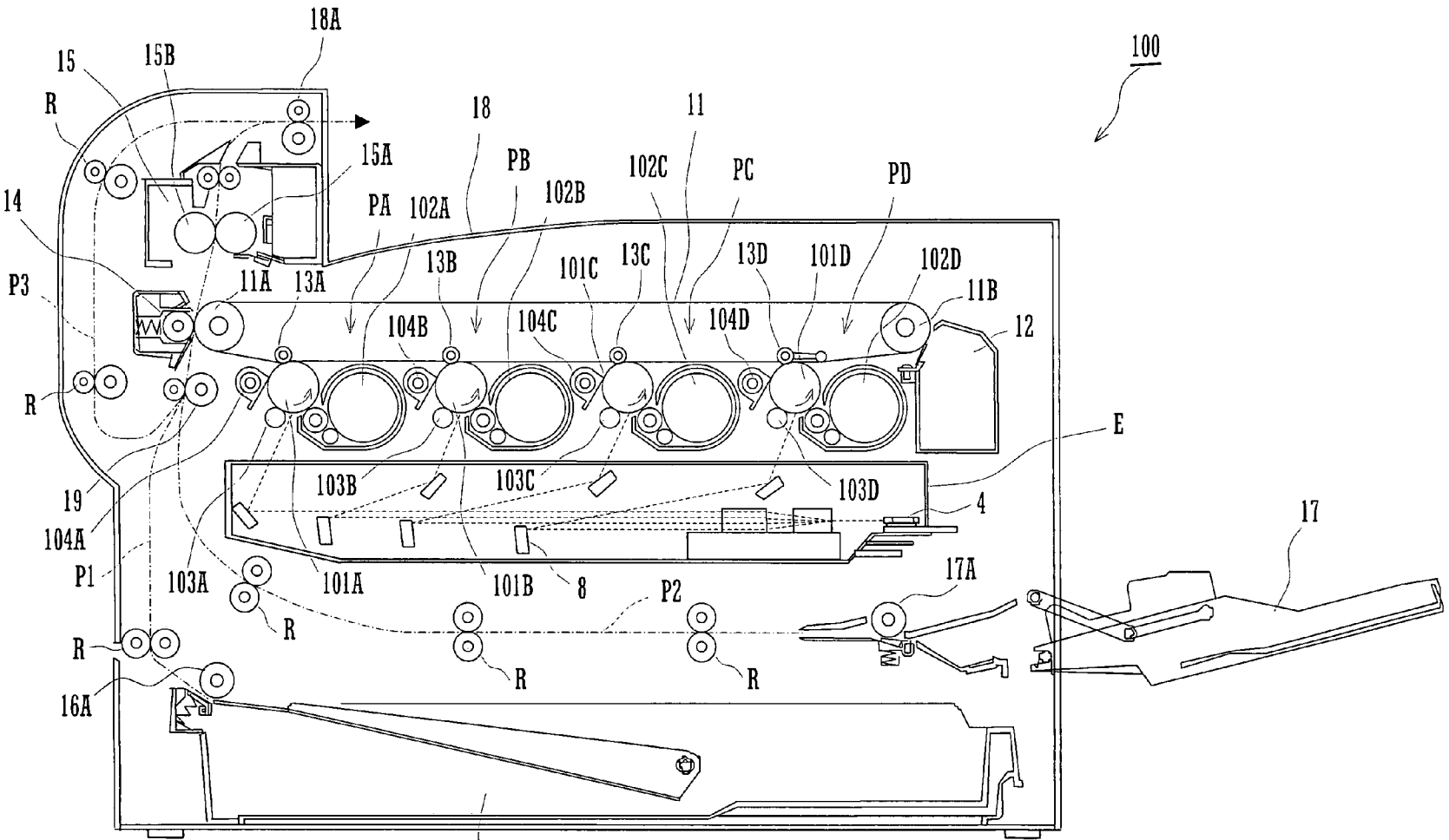
FIG. 2 is a schematic view showing the construction of an image forming apparatus including a transfer device embodying the present invention.

Referring to FIG. 2 showing the construction of an image forming apparatus 100 including a transfer device embodying the present invention, the image forming apparatus 100 forms a multi-color or monochromatic image on a recording medium, such as a recording sheet, according to image data transmitted from the outside. For this purpose, the image forming apparatus 100 includes an exposure unit E, photosensitive drums (each corresponding to the "image carrier" defined by the present invention) 101 (101A to 101D), developing units 102 (102A to 102D), charger rollers 103 (103A to 103D), cleaning units 104 (104A to 104D), an intermediate transfer belt (corresponding to the "endless belt" defined by the present invention) 11, primary transfer rollers (each corresponding to the "transfer roller" defined by the present invention and referred to as transfer roller hereinafter) 13 (13A to 13D), a secondary transfer roller 14, a fixing device 15, sheet transport paths P1 to P3, a sheet feed cassette 16, a manual feed tray 17, an ejected sheet tray 18, and the like.

The image forming apparatus 100 performs image formation using image data items corresponding to four colors including black (K) in addition to the three subtractive primary colors, i.e., yellow (Y), magenta (M) and cyan (C), which are obtained by color separation of a color image. Four combinations of photosensitive drum 101 (101A to 101D), developing unit 102 (102A to 102D), charger roller 103 (103A to 103D), transfer roller 13 (13A to 13D) and cleaning unit 104 (104A to 104D) are provided corresponding to the four colors to form four image forming stations SA to SD. The image forming stations SA to SD are aligned in a row along the direction of movement of the intermediate transfer roller 11 (secondary scanning direction).

Each of the charger rollers 103 is a contact type charger adapted to electrostatically charge the surface of the associated photosensitive drum 101 to a predetermined potential uniformly. Instead of charger roller 103, it is possible to use a contact type charger employing a charger brush or a non-contact type charger device employing a static charger. The exposure unit E, which includes a non-illustrated semiconductor laser, a polygonal mirror 4, a reflecting mirror 8, and the like, irradiates the photosensitive drums 101A to 101D with respective laser beams modulated according to image data items corresponding to respective of the colors, i.e., black, cyan, magenta and yellow, thereby forming latent images on the respective photosensitive drums 101A to 101D according to the image data items. Thus, the photosensitive drums 101A to 101D are formed with respective latent images based on the image data items respectively corresponding to black, cyan, magenta and yellow.

Each of the developing units 102 supplies a developer to the surface of the associated photosensitive drum 101 formed with a respective one of the latent images to turn the latent image into a visible toner image. The developing units 102A to 102D have stored therein a black developer, a cyan developer, a magenta developer and a yellow developer, respectively, for developing each of the latent images formed on the respective photosensitive drums 101A to 101D into a respective one of a black toner image, a cyan toner image, a magenta toner image and a yellow toner image. Each of the cleaning units 104 removes and collects residual toner which remains on the surface of the associated photosensitive drum 101 after the development and transfer process has been completed.

The intermediate transfer belt 11 extending over the photosensitive drums 101 is entrained about a driving roller 11A and a driven roller 11B to form a looped path of movement. The intermediate transfer belt 11 has an outer peripheral surface coming to face the photosensitive drums in the order of 101D, 101C, 101B and 101A. The transfer rollers 13A to 13D are opposed to the photosensitive drums 101A to 101D, respectively, across the intermediate transfer belt 11. The transfer rollers 13A to 13D are applied with transfer bias of opposite polarity to the polarity of toner electrostatically charged in order to transfer toner images carried on the respective photosensitive drums 101A to 101D to the intermediate transfer belt 11. Thus, the toner images of the respective colors formed on the respective photosensitive drums 101 (101A to 101D) are sequentially transferred to the outer peripheral surface of the intermediate transfer belt 11 so as to be superimposed one upon another, thereby forming a full-color toner image on the outer peripheral surface of the intermediate transfer belt 11.

If image data items corresponding to only some of the colors, yellow, magenta, cyan and black are inputted, only those of the four photosensitive drums 101A to 101D which correspond to the colors corresponding to the inputted image data items are formed with respective latent images and then toner images. In forming a monochromatic image for example, only the photosensitive drum 101A corresponding to black is formed with a latent image and then a black toner image, followed by transfer of only the black toner image to the outer peripheral surface of the intermediate transfer belt 11.

The toner image thus formed on the outer peripheral surface of the intermediate transfer belt 11 is transported by revolution of the intermediate transfer belt 11 to a position opposite to the secondary transfer roller 14. During image formation the secondary transfer roller 14 is pressed at a predetermined nip pressure against the outer peripheral surface of the intermediate transfer belt 11 at a location where the inner peripheral surface of the intermediate transfer roller 11 is in contact with the driving roller 11A. The secondary transfer roller 14 is applied with a high voltage of opposite polarity to the polarity of charged toner during passage of a recording sheet fed from the sheet feed cassette 16 or the manual feed tray 17 between the secondary transfer roller 14 and the intermediate transfer belt 11. This operation causes the toner image to be transferred from the outer peripheral surface of the intermediate transfer belt 11 to a surface of the recording sheet.

For the nip pressure between the secondary transfer roller 14 and the intermediate transfer belt 11 to be kept at the predetermined value, one of the secondary transfer roller 14 and the driving roller 11A is formed of a hard material (such as a metal), while the other formed of a soft material such as a resilient roller (resilient rubber roller or foamed resin roller for example).

Of the toner attached to the intermediate transfer belt 11 from the photosensitive drums 101, residual toner fractions which remain on the intermediate transfer belt 11 without having been transferred to the recording sheet are collected by the cleaning unit 12 to avoid color mixture in the succeeding process.

The recording sheet bearing the toner image transferred thereto is guided to the fixing device 15 where the recording sheet is subjected to heat and pressure during its passage between a heating roller 15A and a pressure roller 15B. This operation allows the toner image to be firmly fixed to the surface of the recording sheet. The recording sheet bearing the toner image thus fixed thereto is ejected by ejection rollers 18A onto the ejected sheet tray 18.

The image forming apparatus 100 defines substantially vertical sheet transport path P1 for transporting recording sheets held in the sheet feed cassette 16 to the ejected sheet tray 18 by passing them between the secondary transfer roller 14 and the intermediate transfer belt 11 and through the fixing device 15. The sheet transport path P1 is provided with a pickup roller 16A operative to pay out the recording sheets of the sheet feed cassette 16 into the sheet transport path P1 one by one, transport rollers R operative to transport each of the paid-out recording sheets upwardly, registration rollers 19 operative to guide each transported recording sheet to between the secondary transfer roller 14 and the intermediate transfer belt 11 with predetermined timing, and the ejection rollers 18A operative to eject each recording sheet onto the ejected sheet tray 18.

Also, the image forming apparatus 100 internally defines sheet transport path P2 which extends from the manual feed tray 17 to the registration rollers 19 and which is provided with a pickup roller 17A and transport rollers R. Further, the image forming apparatus 100 defines sheet transport path P3 extending from the ejection rollers 18A to the upstream side of the registration rollers 19 in the sheet transport path P1.

The ejection rollers 18A are forwardly and backwardly rotatable. The ejection rollers 18A are rotated forwardly to eject a recording sheet onto the ejected sheet tray 18 either in a one-sided image formation mode in which an image is formed on one side of a recording sheet or during the second side image forming process in a double-sided image formation mode in which images are formed on the both sides of a recording sheet. During the first side image forming process in the double-sided image formation mode, on the other hand, the ejection rollers 18A are rotated forwardly until the trailing edge of a recording sheet has passed through the fixing device 15 and then driven backwardly with the trailing edge of the recording sheet caught therebetween to guide the recording sheet into the sheet transport path P3. This operation causes the recording sheet bearing an image on one side thereof to be turned upside down and front side back and guided to the sheet transport path P1.

The registration rollers 19 guide a recording sheet fed thereto from the sheet feed cassette 16 or the manual feed tray 17 or through the sheet transport path P3 to between the secondary transfer roller 14 and the intermediate transfer belt 11 in synchronization with revolution of the intermediate transfer belt 11. For this purpose, the registration rollers 19 stop rotating in the beginning of the operation of the photosensitive drums 101 or intermediate transfer belt 11 and, therefore, a recording sheet fed or transported prior to the revolution of the intermediate transfer belt 11 stops traveling in the sheet transport path P1 with its front or leading edge abutting against the registration rollers 19. Thereafter, the registration rollers 19 start rotating with such timing as to register the leading edge of the recording sheet with the leading edge of a toner image on the intermediate transfer belt 11 at the location where the secondary transfer roller 14 presses against the intermediate transfer belt 11.

Figure 3:
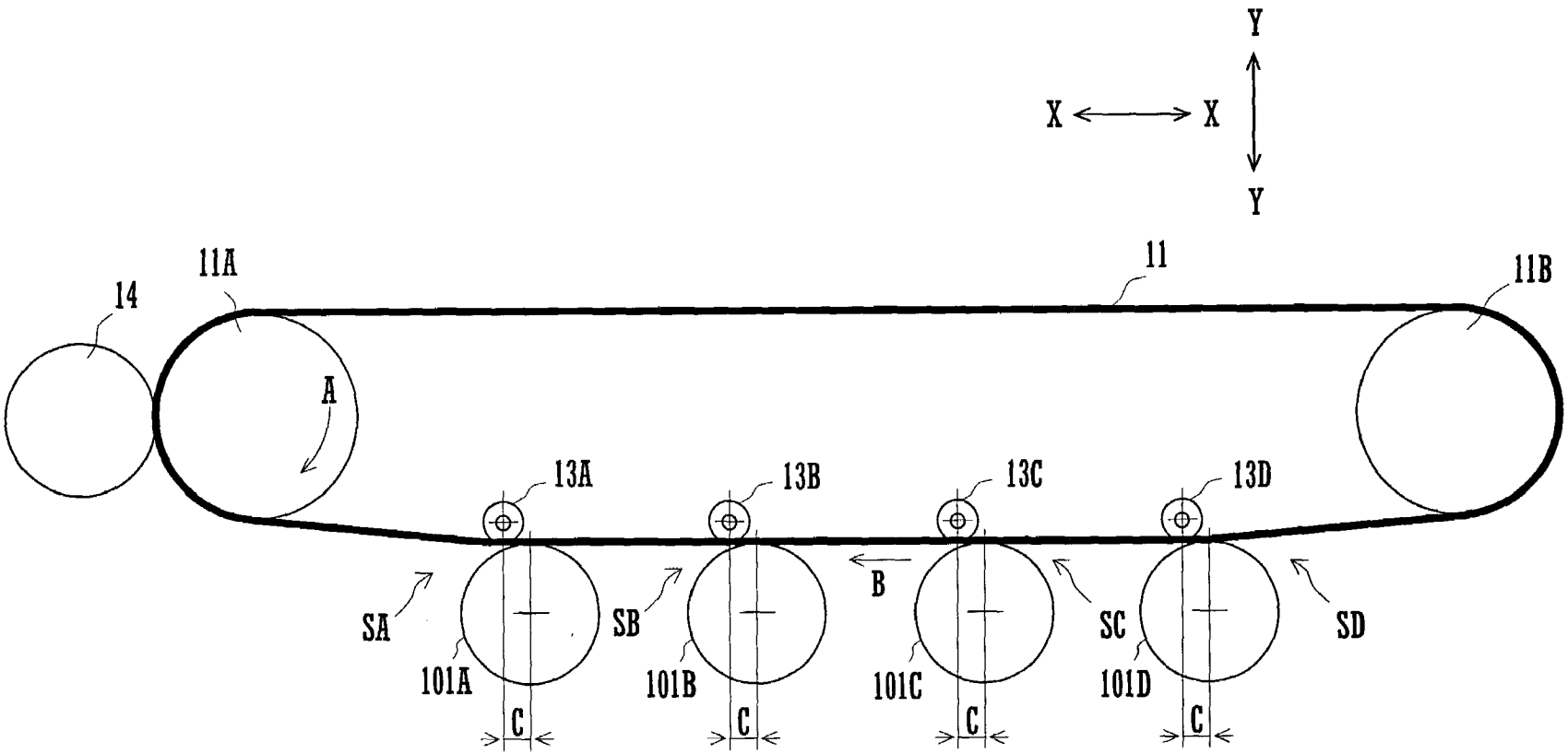
FIG. 3 is a view showing the path along which an intermediate belt included in the image forming apparatus shown in FIG. 2 moves during full-color image formation.
Figure 4:
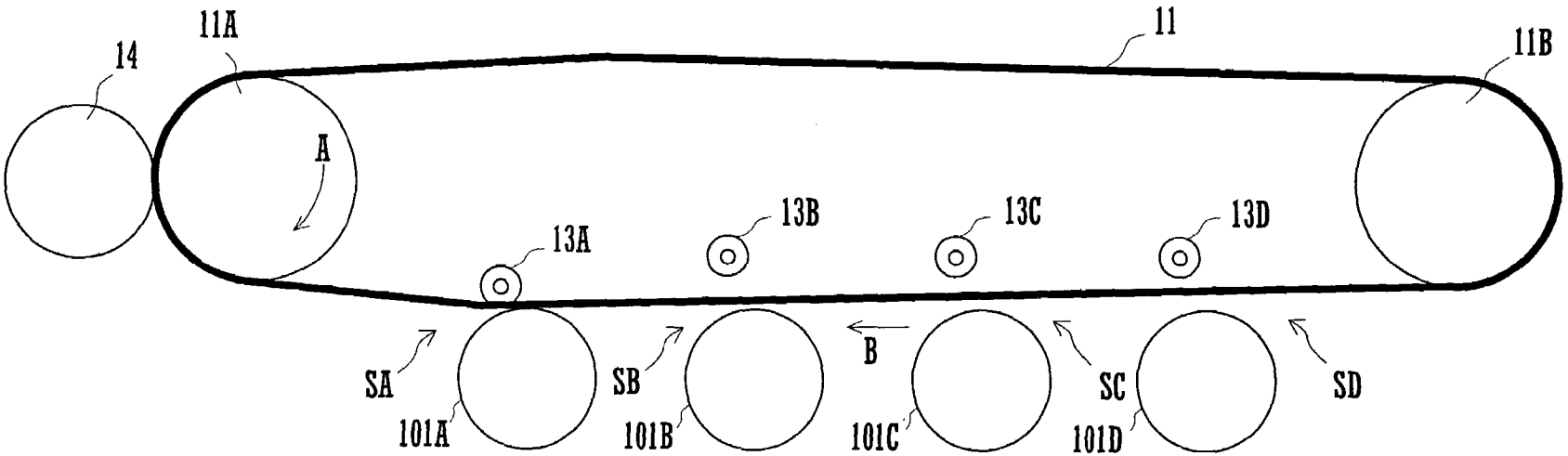
FIG. 4 is a view showing the path along which the intermediate belt included in the image forming apparatus shown in FIG. 2 moves during monochromatic image formation.

FIGS. 3 and 4 are views showing paths of movement of the intermediate transfer belt included in the above-described image forming apparatus. Specifically, FIG. 3 is a view showing the path along which the intermediate transfer belt moves during full-color image formation, while FIG. 4 is a view showing the path along which the intermediate transfer belt moves during monochromatic image formation. The intermediate transfer belt 11 is entrained about the driving roller 11A and the driven roller 11B to define a looped path of movement including substantially horizontal upper and lower ranges. Under the intermediate transfer belt 11 are disposed the photosensitive drums 101A to 101D of the respective image forming stations SA to SD. The photosensitive drums 101A to 101D are aligned in a row along the lower range of the path of movement of the intermediate transfer belt 11, so that the outer peripheral surface of the intermediate transfer belt 11 faces the photosensitive drums 101A to 101D within the lower range of the path of movement. The intermediate transfer belt 11 moves in the direction indicated by arrow B as the driving roller 11A rotates in the direction indicated by arrow A.

The transfer rollers 13A to 13D included in the respective image forming stations SA to SD are positioned internally of the looped path of movement of the intermediate transfer belt 11. Each of the transfer rollers 13A to 13D is rotatably supported on a shaft so as to be movable in the vertical direction (Y—Y direction) at a position facing a respective one of the photosensitive drums 101A to 101D across the intermediate transfer belt 11. Accordingly, the transfer rollers 13A to 13D are movable toward and away from the respective photosensitive drums 101A to 101D. The rotating shaft of each of the transfer rollers 13A to 13D is spaced a distance C downstream from the rotating shaft of the associated one of the photosensitive drums 101A to 101D in the direction of movement of the intermediate transfer belt 11.

In full-color image formation, the transfer rollers 13A to 13D are all positioned close to the respective photosensitive drums 101A to 101D while contacting the inner surface of the intermediate transfer belt 11, as shown in FIG. 2. The intermediate transfer belt 11 is deformed to project downwardly at its portions facing the transfer rollers 13A to 13D within the lower range of the path of movement while contacting the peripheries of the respective photosensitive drums 101A to 101D at the outer surface thereof. Toner images of the respective colors, i.e., yellow, magenta, cyan and black, are transferred in this order from the respective photosensitive drums 101D, 101C, 101B and 101A to the outer surface of the intermediate transfer belt 11 moving within the lower range of the path of movement.

In monochromatic image formation, only the transfer roller 13A of the transfer rollers 13A to 13D is positioned close to the photosensitive drum 101A and brought into contact with the inner surface of the intermediate transfer belt 11, as shown in FIG. 4. Other transfer rollers 13B to 13D are positioned apart from the photosensitive drums 101B to 101D, respectively, and are out of contact with the inner surface of the intermediate transfer belt 11.

The intermediate transfer belt 11 is deformed to project downwardly only at its portion facing the transfer roller 13A within the lower range of the path of movement while contacting the periphery of only the photosensitive drum 101A at the outer surface thereof. A black toner image is transferred from the photosensitive drum 101A to the outer surface of the intermediate transfer belt 11 moving within the lower range of the path of movement.

During standby before the image forming operation, all the transfer rollers 13A to 13D are positioned apart from the respective photosensitive drums 101A to 101D and are out of contact with the inner surface of the intermediate transfer belt 11.

The intermediate transfer belt 11 is formed of a material that can hardly expand and contract. For this reason, the full length of the path of movement of the intermediate transfer belt 11 is made constant throughout the full-color image formation process, monochromatic image formation process and the standby status.

Figure 5A:
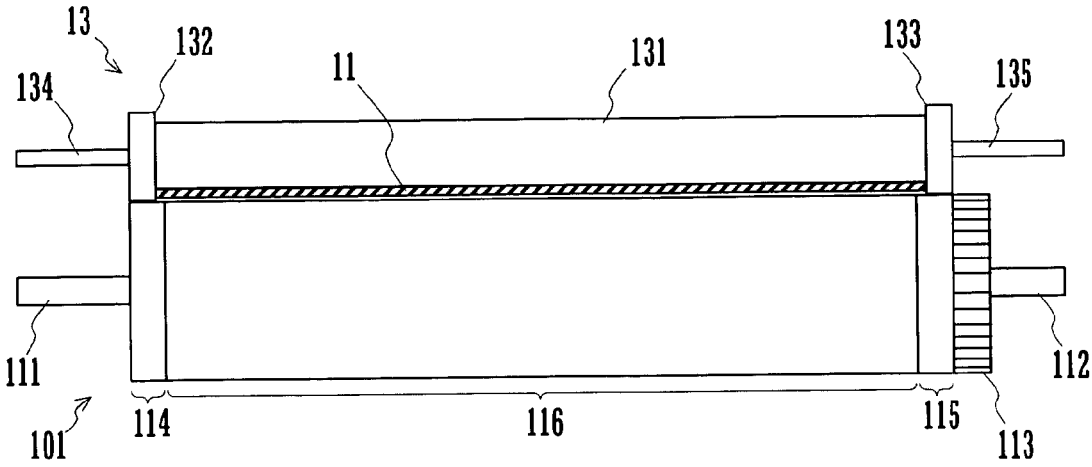
FIGS. 5A to 5C are views illustrating an arrangement in which the intermediate transfer belt, photosensitive drum and transfer roller of the image forming apparatus shown in FIG. 2 are positioned.
Figure 5B:
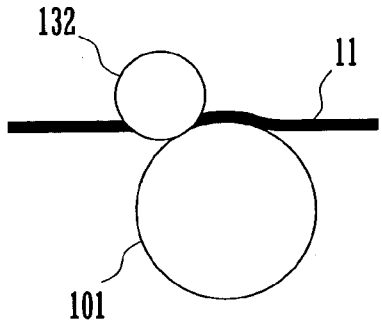
Figure 5C:
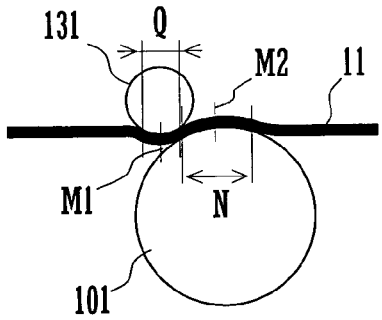

FIGS. 5A to 5C are views illustrating an arrangement in which the intermediate transfer belt, photosensitive drum and transfer roller of the image forming apparatus are positioned. The photosensitive drum 101 has front and rear ends which are supported by respective rotating shafts 111 and 112 on the image forming apparatus 100. A driving gear 113 is secured to the rear end of the photosensitive drum 101 to supply rotational power to the photosensitive drum 101 via a transmission gear not shown. The periphery of the photosensitive drum 101 has axially opposite end portions respectively formed with non-image areas 114 and 115. An image forming area 116 other than the non-image areas 114 and 115 on the periphery of the photosensitive drum 101 is subjected to latent image formation and toner image formation based on image information.

The transfer roller 13 comprises a small-diameter portion 131, and large-diameter portions 132 and 133 forming a front end portion and a rear end portion, respectively, of the transfer roller 13. The transfer roller 13 is rotatably supported at its front and rear end portions by respective rotating shafts 134 and 135 on the image forming apparatus 100. The small-diameter portion 131 and the large-diameter portions 132 and 133 are coaxially aligned. As shown in FIGS. 5A and 5B, the peripheries of the respective large-diameter portions 132 and 133 abut against the non-image areas 114 and 115, respectively, of the periphery of the photosensitive drum 101, thereby positioning the transfer roller 13 relative to the photosensitive drum 101.

The difference in radius between the small-diameter portion 131 and each of the large-diameter portions 132 and 133 is made larger than the thickness of the intermediate transfer belt 11. The width of the small-diameter portion 131 in the axial direction is made substantially equal to the width of the image forming area 116 of the photosensitive drum 101 in the axial direction and to the width of the intermediate transfer belt 11. The inside surfaces of the large-diameter portions 132 and 133 limit movement of the intermediate transfer belt 11 in the widthwise direction (i.e., along the axis of the photosensitive drum 101), thereby preventing the intermediate transfer belt 11 from meandering.

The large-diameter portions 132 and 133 are formed from an electrical insulating material and, hence, the transfer voltage applied to the small-diameter portion 131 is prevented from acting on the photosensitive drum 101 through the large-diameter portions 132 and 133. For this reason, the transfer voltage does not disturb an electrostatic latent image or a toner image on the periphery of the photosensitive drum 101. By imparting the peripheral surface of each of the large-diameter portions 132 and 133 with a hardness of 60 degrees (on Ascar C hardness scale), the large-diameter portions 132 and 133 can be prevented from deformation due to contact with the periphery of the photosensitive drum 101.

The small-diameter portion 131 can be constructed of a cylindrical metal material for example. For this reason, the periphery of the small-diameter portion 131 need not be formed of a resilient material as in the conventional transfer roller, which incurs no increase in cost and ensures high dimensional precision. Further, the small-diameter portion 131 can hardly deform with time and hence can enjoy a prolonged life.

As shown in FIGS. 3 and 4, the rotating shaft of each of the transfer rollers 13 is spaced a predetermined distance (distance C in FIG. 3) downstream from the rotating shaft of the associated one of the photosensitive drums 101 in the direction of movement of the intermediate transfer belt 11. During full-color image formation the transfer rollers 13A to 13D abut against the inner surface of the intermediate transfer belt 11, whereas during monochromatic image formation the transfer roller 13A abuts the inner surface of the intermediate transfer belt 11. In those cases each transfer roller 13 abuts the inner surface of the intermediate transfer belt 11 at a location downstream of the rotating shaft of the associated photosensitive drum 101 in the direction of movement of the intermediate transfer belt 11, thereby deforming the path of movement of the intermediate transfer belt 11 as shown in FIG. 5C.

The deformation of the path of movement causes the outer surface of the intermediate transfer belt 11 to contact the periphery of the photosensitive drum 101 in transfer nip region N extending over predetermined range. At this time the rotating shaft of the transfer roller 13 is offset relative to the rotating shaft of the photosensitive drum 101 in the direction of movement of the intermediate transfer belt 11. Accordingly, center M1 of contact range Q defined between the transfer roller 13 and the inner surface of the intermediate transfer belt 11 is spaced apart from center M2 of the contact range (transfer nip region N) defined between the photosensitive drum 101 and the outer surface of the intermediate transfer belt 11 in the direction of movement of the intermediate transfer belt 11.

The difference in radius between the small-diameter portion 131 and each of the large-diameter portions 132 and 133 is larger than the thickness of the intermediate transfer belt 11. Accordingly, the intermediate transfer belt 11 is not directly held between the transfer roller 13 and the photosensitive drum 101 and, hence, the transfer roller 13 does not exert any pressing force on the intermediate transfer belt 11 in the transfer nip region N.

For this reason, the intermediate transfer belt 11 is pressed against the periphery of the photosensitive drum 101 by tension exerted thereon in the direction of movement due to deformation of the path of movement, thereby defining transfer nip region N having a predetermined width which is needed for transfer of the toner image. Therefore, an undesirably large pressing force will not act between the intermediate transfer belt 11 and the photosensitive drum 101. Thus, aggregation of toner on the intermediate transfer belt 11 can be prevented, which can obviate the occurrences of such inconveniences as contamination of and damage to the interior of the image forming apparatus 100 by aggregated toner, defective transfer from the intermediate transfer belt 11 to a recording sheet, and undesirable mixture of toner colors due to transport of aggregated toner into the developing unit 102 of another image forming station by revolution of the intermediate transfer belt 11.

Further, since the portion of the transfer roller 13 contacting the inner surface of the intermediate transfer belt 11 is located downstream of the transfer nip region N defined between the outer surface of the intermediate transfer belt 11 and the photosensitive drum 101 in the direction of movement of the intermediate transfer belt 11, the transfer electric field produced by the transfer roller 13 cannot cause a toner image on the periphery of the photosensitive drum 101 before reaching the transfer nip region N to be scattered, which ensures reliable toner image transfer to the outer surface of the intermediate transfer belt 11.

In the case where the transfer roller 13 is configured to allow the large-diameter portions 132, 133 and the small-diameter portion 131 to rotate together, the periphery of each of the large-diameter portions 132 and 133 should have a resistance to slip of 0.5 or less. Since the large-diameter portions 132, 133 and the small-diameter portion 131, which are different in radius from each other, rotate at equal angular velocity, the large-diameter portions 132, 133 contacting the periphery of the photosensitive drum 101 rotate at a different circumferential velocity than does the small-diameter portion 131 contacting the intermediate transfer belt 11. For this reason, the periphery of each of the large-diameter portions 132 and 133 needs to slip on the periphery of the photosensitive drum 101.

Alternatively, in the case where the transfer roller 13 is configured to allow the large-diameter portions 132, 133 and the small-diameter portion 131 individually, the periphery of each of the large-diameter portions 132 and 133 should have a resistance to slip of 1.0 or more. This is because, since the large-diameter portions 132, 133 and the small-diameter portion 131 fail to restrain each other in circumferential velocity, the circumferential velocity of the large-diameter portions 132, 133 should be equalized to that of photosensitive drum 101 in order to stabilize the rotation of the transfer roller 13.

The foregoing embodiment should be construed to be illustrative and not limitative of the present invention in all the points. The scope of the present invention is defined by the following claims, not by the foregoing embodiment. Further, it is intended that the scope of the present invention include the scopes of the claims and all the possible changes and modifications within the sense and scope of equivalents.

What is claimed is:

1. A transfer device comprising:

an endless belt operative to move with an outer surface thereof contacting a periphery of a drum-shaped image carrier; and a transfer roller capable of contacting an inner surface of the endless belt, wherein the transfer roller and the endless belt define therebetween a contact range of which center lies at a location different from a center of a contact range defined between the image carrier and the endless belt in the direction of movement of the endless belt; and wherein the transfer roller has a small-diameter portion having a periphery for contacting the inner surface of the endless belt, and large-diameter portions having respective peripheries for abutting the periphery of the image carrier at opposite ends of the small-diameter portion, the small-diameter portion and the large-diameter portions being coaxially rotatable.

2. The transfer device according to claim 1, wherein the small-diameter portion is formed from an electrical conductive material, while the large-diameter portions formed from an electrical insulating material.

3. The transfer device according to claim 1, wherein the small-diameter portion and each of the large-diameter portions have a difference in radius therebetween which is larger than a thickness of the endless belt.

4. The transfer device according to claim 1, wherein the small-diameter portion and the large-diameter portions are configured to rotate together.

5. The transfer device according to claim 1, wherein the small-diameter portion and the large-diameter portions are configured to rotate individually.

6. The transfer device according to claim 1, wherein the small-diameter portion is formed from a metal material.

7. The transfer device according to claim 1, wherein the center of the contact range defined between the transfer roller and the endless belt lies downstream of the center of the contact range defined between the image carrier and the endless belt in the direction of movement of the endless belt.

8. The transfer device according to claim 1, wherein:

the image carrier comprises a plurality of image carriers provided for respective of image information items respectively corresponding to different colors, the image carriers being arranged along the direction of movement of the endless belt; and the transfer roller comprises a plurality of transfer rollers associated with respective of the image carriers.

* * * * *